US008447618B2

(12) United States Patent
Moon et al.

(10) Patent No.: US 8,447,618 B2
(45) Date of Patent: May 21, 2013

(54) METHOD AND APPARATUS FOR ENCODING AND DECODING RESIDUAL SIGNAL

(75) Inventors: Han-gil Moon, Seoul (KR); Nam-suk Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 344 days.

(21) Appl. No.: 12/831,353

(22) Filed: Jul. 7, 2010

(65) Prior Publication Data

US 2011/0040566 A1 Feb. 17, 2011

(30) Foreign Application Priority Data

Aug. 17, 2009 (KR) ..... 10-2009-0075736

(51) Int. Cl.
*G10L 19/00* (2006.01)

(52) U.S. Cl.
USPC ..... 704/500; 704/500.1

(58) Field of Classification Search
USPC ..... 704/500, 500.1
See application file for complete search history.

(56) References Cited

U.S. PATENT DOCUMENTS

| | | | | |
|---|---|---|---|---|
| 6,169,973 | B1 * | 1/2001 | Tsutsui et al. | 704/500 |
| 7,333,929 | B1 * | 2/2008 | Chmounk et al. | 704/200 |
| 2005/0091040 | A1 * | 4/2005 | Nam et al. | 704/201 |
| 2008/0004869 | A1 * | 1/2008 | Herre et al. | 704/211 |
| 2010/0070284 | A1 * | 3/2010 | Oh et al. | 704/500 |

* cited by examiner

*Primary Examiner* — Jakieda Jackson
(74) *Attorney, Agent, or Firm* — Sughrue Mion, PLLC

(57) ABSTRACT

A residual signal decoding method including dividing a signal into a plurality of sub-bands in a frequency domain, wherein the signal is in a residual signal and is encoded with respect to an effective residual signal exceeding a masking curve that is generated with respect to a multi-channel audio signal, transforming the frequency domain into a time domain, and restoring the signal as an effective residual signal by synthesizing signals of the domain-transformed sub-bands.

20 Claims, 5 Drawing Sheets

METHOD AND APPARATUS FOR ENCODING AND DECODING RESIDUAL SIGNAL

CROSS-REFERENCE TO RELATED PATENT APPLICATION

This application claims the benefit of Korean Patent Application No. 10-2009-0075736, filed on Aug. 17, 2009, in the Korean Intellectual Property Office, the disclosure of which is incorporated herein in its entirety by reference.

BACKGROUND

1. Field of the Invention

The exemplary embodiments relate to a method and apparatus for encoding and decoding a residual signal, and more particularly, to a method and apparatus for coding a residual signal by using a masking curve that is generated from an audio signal.

2. Description of the Related Art

In general, in order to encode a multi-channel audio signal, the multi-channel audio signal is downmixed to generate a mono or stereo signal, and the mono or stereo signal is transmitted to a decoding apparatus. However, when the decoding apparatus upmixes the downmixed audio signal, a difference signal is generated between the multi-channel audio signal and the upmixed audio signal.

In order to prevent generation of the difference signal, when an audio signal encoding apparatus encodes the multi-channel audio signal, the audio signal encoding apparatus performs encoding on the difference signal and then transmits the difference signal to the decoding apparatus. The audio signal encoding apparatus divides the difference signal into a plurality of sub-bands, obtains an average energy in each sub-band, decodes the average energy, and thus encodes the difference signal.

SUMMARY

The exemplary embodiments provide a method and apparatus for coding a residual signal by using a masking curve that is generated from an audio signal.

The exemplary embodiments also provide a residual signal encoding and decoding method and apparatus therefor which includes sorting and encoding residual signals that are generated according to multi channels, decoding the sorted residual signals, and separating the decoded residual signals according to the channels by using sorting information for separating the decoded residual signals according to the channels.

According to an aspect of an exemplary embodiment, there is provided a residual signal encoding method including the operations of obtaining a residual signal indicating a difference between a multi-channel audio signal, and an audio signal downmixed from the multi-channel audio signal and then upmixed from the downmixed audio signal by using additional information: generating a masking curve from the multi-channel audio signal; extracting a signal that is not masked by the masking curve and that is in the residual signal, and obtaining the signal as an effective residual signal; and encoding the effective residual signal.

The operation of obtaining the signal as the effective residual signal may include the operations of transforming the residual signal into a frequency domain and dividing the residual signal into a plurality of sub-bands; and extracting a signal exceeding a masking value of the masking curve, according to each of the plurality of sub-bands. Also, the residual signal and the masking curve may be generated according to each of multi channels forming the multi-channel audio signal, the operation of obtaining the signal as the effective residual signal may include the operation of obtaining an effective residual signal that exceeds the masking curve and that is in the residual signal, according to each of the multi channels, and the residual signal encoding method may further include the operation of sorting the effective residual signals that are obtained according to the multi channels.

The residual signal encoding method may further include the operation of generating sorting information for separating the sorted effective residual signals into the effective residual signals generated according to the multi channels, and the sorting information may include channel identification information for identifying each of the multi channels, domain identification information for indicating whether the effective residual signals have been sorted on a frequency axis or a time axis, and location information for indicating frequency or time values of the effective residual signals.

According to another aspect of an exemplary embodiment, there is provided a residual signal decoding method including the operations of dividing an encoded effective residual signal into a plurality of sub-bands in a frequency domain; transforming encoded effective residual signal divided into a plurality of sub-bands in the frequency domain into a time domain; and restoring an effective residual signal by synthesizing signals of the plurality of domain-transformed sub-bands, wherein the encoded effective residual signal is generated by encoding a signal that is in a residual signal and that is not masked by a masking curve generated with respect to a multi-channel audio signal.

The encoded effective residual signal may include effective residual signals that are generated according to multi channels, sorted, and then encoded, and the residual signal decoding method may further include the operation of separating the restored effective residual signal into an effective residual signal with respect to each of the multi channels. Also, the operation of separating the restored effective residual signal may include the operations of extracting channel identification information for identifying each of the multi channels, domain identification information for indicating whether the effective residual signal has been sorted on a frequency axis or a time axis, and location information for indicating a frequency or time value of the effective residual signal, and separating the restored effective residual signal according to each of the multi channels by using the channel identification information, the domain identification information, and the location information.

According to another aspect of an exemplary embodiment, there is provided a residual signal generating unit for obtaining a residual signal indicating a difference between a multi-channel audio signal, and an audio signal downmixed from the multi-channel audio signal and then upmixed from the downmixed audio signal by using additional information; a masking curve generating unit for generating a masking curve from the multi-channel audio signal; an effective residual signal extracting unit for extracting a signal that is not masked by the masking curve and that is in the residual signal, and obtaining the signal as an effective residual signal; and an effective residual signal encoding unit for encoding the effective residual signal.

According to another aspect of an exemplary embodiment, there is provided a residual signal decoding apparatus including an effective residual signal decoding unit for dividing an encoded effective residual signal into a plurality of sub-bands on a frequency domain, transforming the encoded effective residual signal divided into the plurality of sub-bands in the frequency domain into a time domain, and restoring an effective residual signal by synthesizing signals of the plurality of domain-transformed sub-bands, wherein the encoded effective residual signal is generated by encoding a signal that is in a residual signal and that is not masked by a masking curve generated with respect to a multi-channel audio signal.

According to another aspect of an exemplary embodiment, there is provided a computer readable recording medium having recorded thereon a program for executing a residual signal encoding method including the operations of obtaining a residual signal indicating a difference between a multi-channel audio signal, and an audio signal downmixed from the multi-channel audio signal and then upmixed from the downmixed audio signal by using additional information; generating a masking curve from the multi-channel audio signal; extracting a signal that is not masked by the masking curve and that is in the residual signal, and obtaining the signal as an effective residual signal; and encoding the effective residual signal.

According to another aspect of an exemplary embodiment, there is provided a computer readable recording medium having recorded thereon a program for executing a residual signal decoding method including the operations of dividing an encoded effective residual signal into a plurality of sub-bands in a frequency domain; transforming the encoded effective residual signal divided into the plurality of sub-bands in the frequency domain into a time domain; and restoring an effective residual signal by synthesizing signals of the plurality of domain-transformed sub-bands, wherein the encoded effective residual signal is generated by encoding a signal that is in a residual signal and that is not masked by a masking curve generated with respect to a multi-channel audio signal.

According to another aspect of an exemplary embodiment, there is provided a method and apparatus for coding a residual signal by using a masking curve that is generated from an audio signal.

According to another aspect of an exemplary embodiment, there is provided a residual signal encoding and decoding method and apparatus therefor which involve sorting and encoding residual signals that are generated according to multi channels, decoding the sorted residual signals, and separating the decoded residual signals according to the channels by using sorting information for separating the decoded residual signals according to the channels.

According to yet another aspect of an exemplary embodiment, an encoding method includes: determining a difference between one channel of a multi-channel audio signal, and an audio signal downmixed from the multi-channel audio signal and then upmixed from the downmixed audio signal; generating a masking curve from the multi-channel audio signal; determining a portion of the difference that does not exceed the masking curve; and encoding the determined portion.

BRIEF DESCRIPTION OF THE DRAWINGS

The above and other features and aspects will become more apparent by describing in detail exemplary embodiments thereof with reference to the attached drawings in which.

DETAILED DESCRIPTION

Hereinafter, the exemplary embodiments will be described in detail with reference to the attached drawings.

Figure 1:
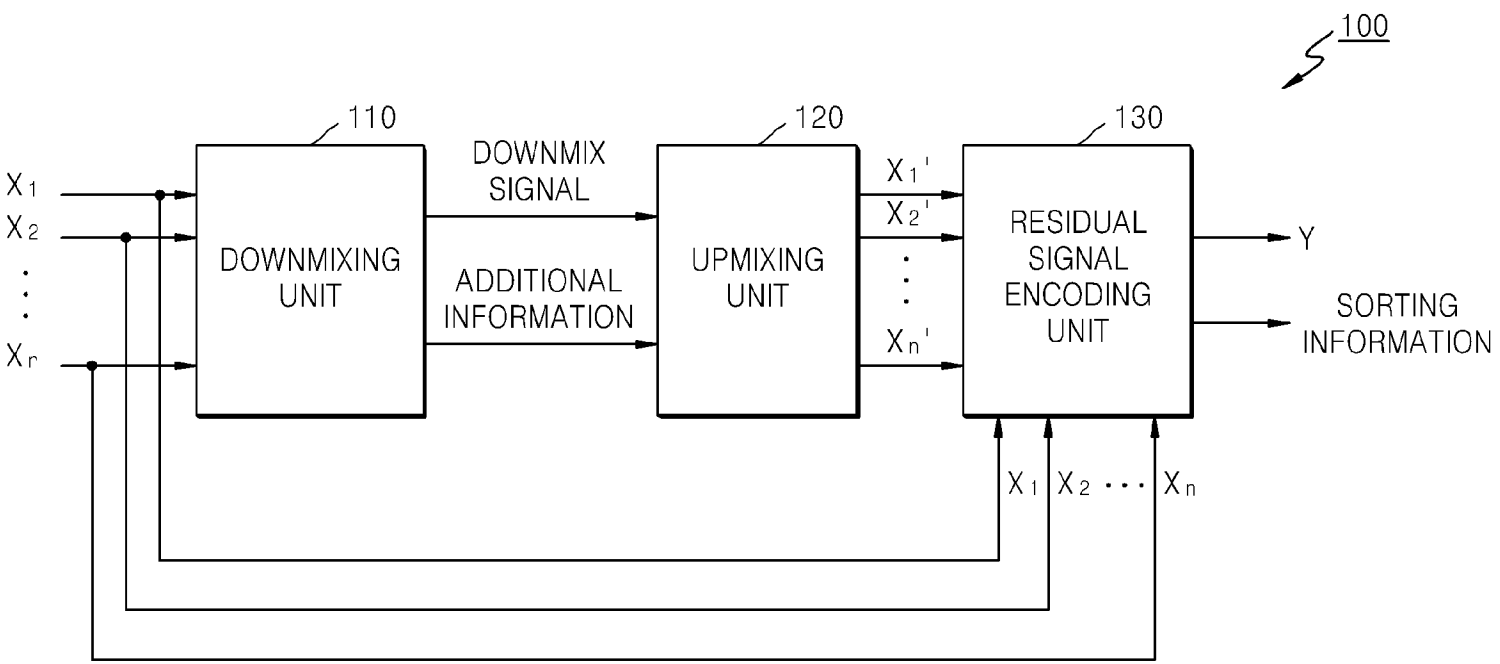
FIG. 1 is an internal block diagram of a residual signal processing device according to an exemplary embodiment.

FIG. 1 is an internal block diagram of a residual signal processing device 100 according to an exemplary embodiment. The residual signal processing device 100 of FIG. 1 includes a downmixing unit 110, an upmixing unit 120, and a residual signal encoding unit 130.

The residual signal processing device 100 of FIG. 1 may be an integral part of an audio signal encoding apparatus (not shown) or may be a stand-alone unit separate from the audio signal encoding apparatus.

An audio signal encoding apparatus (not shown) generates a mono or stereo signal by downmixing an original multi-channel audio signal, and encodes the mono or stereo signal.

An audio signal decoding apparatus (not shown) decodes the encoded audio signal transmitted from the audio signal encoding apparatus, and restores a multi-channel audio signal by upmixing the decoded audio signal. At this time, a difference may occur between the multi-channel audio signal that is restored by the audio signal decoding apparatus and the original multi-channel audio signal before being encoded by the audio signal encoding apparatus.

In order to prevent this difference, the audio signal encoding apparatus downmixes the original multi-channel audio signal, restores the multi-channel audio signal by upmixing the downmixed audio signal in the same manner as the audio signal decoding apparatus does, obtains a difference signal indicating a difference between the restored multi-channel audio signal and the original multi-channel audio signal, and then transmits the difference signal to the audio signal decoding apparatus. In this manner, a signal indicating a difference between an original audio signal before being downmixed and an audio signal restored by upmixing again the downmixed original audio signal is called a residual signal.

Referring to FIG. 1, the downmixing unit 110 downmixes an audio signal formed of n multi channels, and generates a mono or stereo downmixed signal. However, the downmixed signal may not be generated by the downmixing unit 110 but may be artificially generated and then given to the upmixing unit 120. The downmixed signal is encoded by a downmix signal encoding unit (not shown) and transmitted to the audio signal decoding apparatus.

The downmixing unit 110 generates additional information indicating a relation between the n multi channels of the audio signal while downmixing the audio signal. The additional information may include channel level differences (CLD) for indicating an energy difference between channels, interchannel correlations (ICC) for indicating coherence or similarity between the channels, or channel prediction coefficients (CPC) for indicating coefficients that are used to predict audio signal values by using other signals. The additional information is encoded by an additional information encoding unit (not shown) and transmitted along with or separately from the encoded downmixed signal to the audio signal decoding apparatus.

The upmixing unit 120 applies the additional information to the audio signal that is downmixed by the downmixing unit 110, and restores the audio signal formed of the n multi channels.

The residual signal encoding unit 130 obtains a residual signal from a difference between the audio signal that is restored by the upmixing unit 120 and the audio signal formed of the n multi channels, which is input to the downmixing unit 110, and encodes the residual signal.

To be more specific, the residual signal encoding unit 130 according to the present exemplary embodiment does not encode all residual signals but selects only psychoacoustically meaningful signals in the residual signals and then encodes the selected signals.

Moving Picture Experts Group (MPEG) audio uses a method of reducing a code amount by omitting low sensitivity detail information by using a sense of human perception, and this method is called perceptual coding. A representative fact related to human auditory senses that are used in the perceptual coding is a masking effect. The masking effect indicates a phenomenon by which a small sound is masked by a big sound so that the small sound becomes non-perceptible. At this time, the big sound, that is, a masking sound is called a masker, and the small sound masked by the masker is called a maskee. The masking effect increases as a difference between a volume of the masker and a volume of the maskee increases, and the masking effect also increases as a frequency of the masker becomes similar to that of the maskee. In addition, although the small sound and the big sound do not occur at a temporally simultaneous time, if a time temporal difference between occurrences of the masker and the maskee is short, the masking effect is still generated.

With respect to the existence of the masker, a line indicating maximum amplitude of a signal that is not perceptible to a person due to the masker is called a masking curve, and a value of the masking curve at a predetermined frequency or time is called a masking value.

The residual signal encoding unit 130 according to the present exemplary embodiment applies the masking curve, which is generated from the audio signal, to the residual signal, thereby not encoding all residual signals but encoding only signals that exceed the masking curve and that are in the residual signals. Hereinafter, the signals that are not masked by the masking curve generated from the audio signal and that are in the residual signals are referred to effective residual signals.

In this manner, according to the present exemplary embodiment, by encoding only an psychologically effective residual signal instead of encoding all residual signals, it is possible to perform a residual signal coding operation by using the small number of bits.

Figure 2:
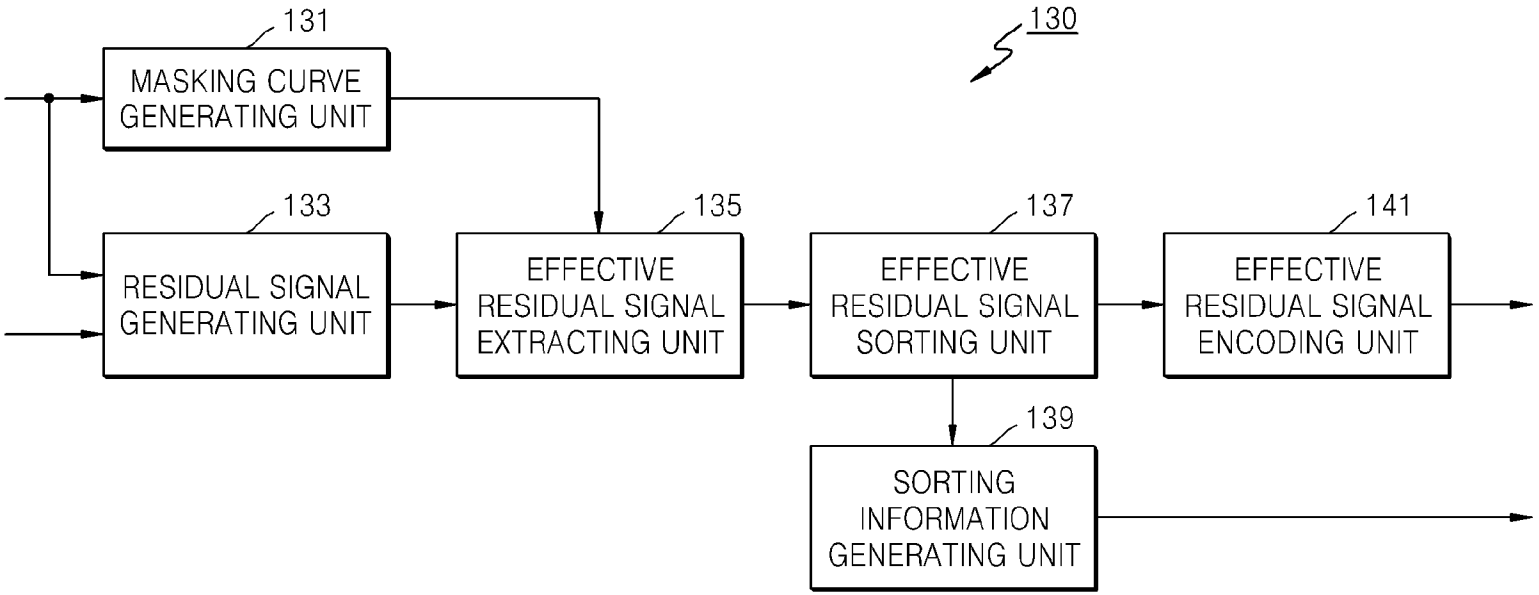
FIG. 2 is an internal block diagram of a residual signal encoding unit in FIG. 1.

FIG. 2 is an internal block diagram of the residual signal encoding unit 130 in FIG. 1. Referring to FIG. 2, the residual signal encoding unit 130 includes a masking curve generating unit 131, a residual signal generating unit 133, an effective residual signal extracting unit 135, an effective residual signal sorting unit 137, a sorting information generating unit 139, and an effective residual signal encoding unit 141.

The residual signal generating unit 133 generates residual signals by using an audio signal. The residual signal generating unit 133 obtains a difference signal indicating a difference between a downmixed-and-restored multi-channel audio signal and an original multi-channel audio signal.

For example, in the case where an audio signal to be encoded is formed of 5.1 channels, the residual signal generating unit 133 generates residual signals for each 6 channels, i.e., a Center Front (C) channel, a Left Front (LF) channel, a Right Front (RF) channel, a Left Surround (LS) channel, a Right Surround (RS) channel, and a woofer (Low Frequency Enhancement: LFE) channel. The residual signal generating unit 133 may obtain the residual signal for the C channel by obtaining a difference between the C channel before being downmixed and the C channel after being downmixed, and then restored by being upmixed. In this manner, the residual signal generating unit 133 may generate the residual signals, which are separate from each other, according to multi channels.

The masking curve generating unit 131 generates a masking curve from the audio signal. According to the present exemplary embodiment, the masking curve generating unit 131 generates the masking curve by using the audio signal instead of the residual signals.

In general, compared to the residual signals, an information amount and amplitude of the audio signal are great, so that the masking curve generated from the audio signal is positioned higher than a masking curve generated from the residual signals. Thus, the amount of signals masked by the masking curve generated from the audio signal is greater than the amount of signals masked by the masking curve generated from the residual signals, and therefore, when the masking curve generated from the audio signal is applied to the residual signals, the amount of residual signals to be encoded is decreased and thus, encoding efficiency is improved.

The masking curve generating unit 131 generates masking curves according to the multi channels, respectively. For example, in the case where an audio signal to be encoded is formed of 5.1 channels, the masking curve generating unit 131 generates 6 masking curves indicating maximum signal amplitudes that are not perceptible to a person when each audio signal that is input to 6 channels is used as a masker.

The effective residual signal extracting unit 135 extracts effective residual signals that are not masked by the masking curves and that are in the residual signals. The effective residual signal extracting unit 135 respectively applies the masking curves, which are generated from the audio signal formed of multi channels, to the residual signals generated according to the multi channels, so that the effective residual signal extracting unit 135 obtains the effective residual signals corresponding to the number of multi channels.

For example, the effective residual signal extracting unit 135 applies a masking curve when a signal of the C channel is used as a masker to a residual signal that is generated with respect to the C channel, and thus extracts a signal as an effective residual signal with respect to the C channel, wherein the signal is psychoacoustically perceptible to a person and is from the residual signal generated with respect to the C channel. In this manner, the effective residual signal extracting unit 135 obtains the effective residual signals with respect to the multi channels, respectively.

The effective residual signal encoding unit 141 encodes the effective residual signals. The effective residual signal encoding unit 141 does not perform encoding on signals that are determined to be meaningless signals via the masking curves and that are in the residual signals. There is a high possibility that the effective residual signals that remain without being masked by the masking curves are not sequential on time and frequency axes, and thus, if differential coding is performed on the effective residual signals, coding efficiency deteriorates.

In order to prevent this, according to the present exemplary embodiment, a method is considered, wherein the method involves coding signal values that are distant from each other on the temporal or frequency axis by decreasing the distance between the signal values.

The effective residual signal sorting unit 137 sorts the effective residual signals that are generated according to the respective multi channels. The sorting of the effective residual signals means that the effective residual signals that are not sequential are re-arranged. The effective residual signal sorting unit 137 may synthesize the effective residual signals generated according to the respective multi channels, and then may arrange effective residual signals whose total is equal to or less than the number of multi channels.

The effective residual signal sorting unit 137 may sort the effective residual signals generated according to the multi channels on the time or frequency axis.

The sorting information generating unit 139 generates sorting information indicating how the effective residual signals are sorted by the effective residual signal sorting unit 137.

The sorting information includes at least one from among channel identification information, domain identification information, and location information, wherein the channel identification information indicates which channel from among the multi channels is related to each effective residual signal and the domain identification information indicates on which axis from among the frequency axis and the time axis the effective residual signals are synthesized.

The location information indicates a frequency value of the effective residual signal in the case where the effective residual signals are synthesized on the frequency axis, or indicates a time value of the effective residual signal in the case where the effective residual signals are synthesized on the time axis.

The effective residual signal encoding unit 141 encodes the effective residual signals that are sorted by the effective residual signal sorting unit 137. The effective residual signal encoding unit 141 divides the sorted effective residual signals into a plurality of sub-bands on a frequency domain, and transforms the sorted effective residual signals divided into the plurality of sub-bands in the frequency domain into a time domain. The effective residual signal encoding unit 141 may use the Quadrature Mirror Filterbank (QMF) or the Lapped Orthogonal Transform (LOT).

The sorting information generating unit 139 transmits the generated sorting information along with the effective residual signal encoded by the effective residual signal encoding unit 141 to the audio signal decoding apparatus.

In this manner, according to the present exemplary embodiment, it is possible to sort the effective residual signals, and to generate the sorting information for separating the sorted effective residual signals into original effective residual signals generated according to the multi channels.

Figure 3:
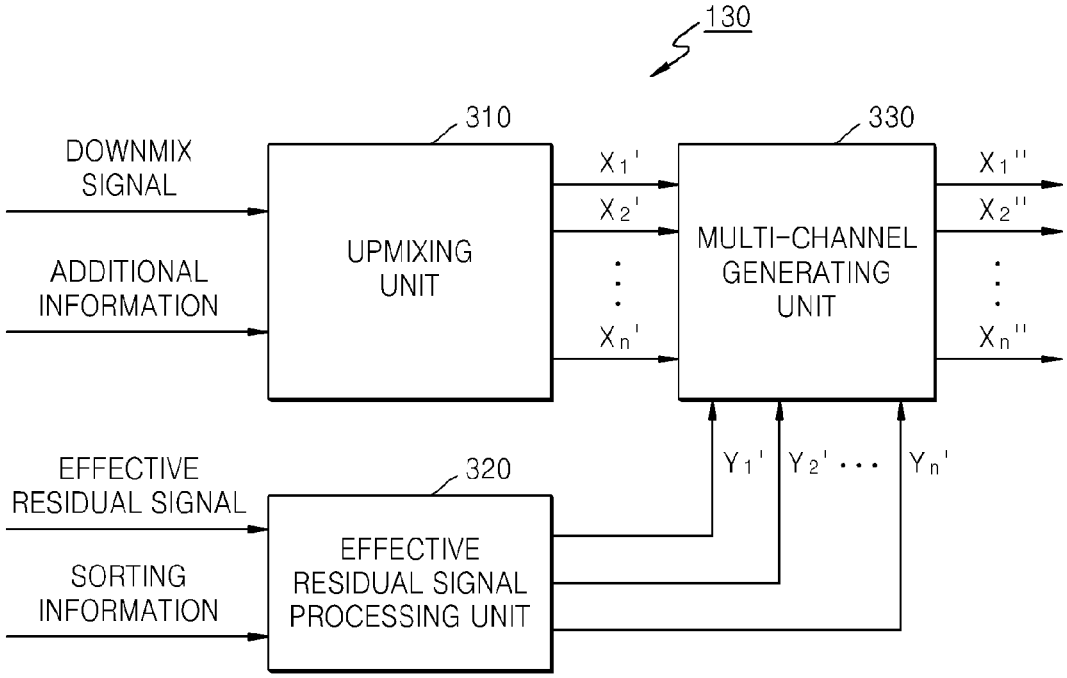
FIG. 3 is a block diagram of an audio signal decoding apparatus according to another exemplary embodiment.

FIG. 3 is a block diagram of an audio signal decoding apparatus 300 according to another exemplary embodiment. Referring to FIG. 3, the audio signal decoding apparatus 300 includes an upmixing unit 310, an effective residual signal processing unit 320, and a multi-channel generating unit 330. Although not illustrated in FIG. 3, the audio signal decoding apparatus 300 may further include an inverse-multiplexing unit for parsing an input bitstream, and a downmix signal decoding unit for decoding a downmix signal that is parsed from the bitstream.

The inverse-multiplexing unit parses the downmix signal, additional information, effective residual signals, and sorting information from the bitstream, transmits the downmix signal to the downmix signal decoding unit, and transmits the effective residual signals and the sorting information to the effective residual signal processing unit 320. The downmix signal decoding unit decodes the parsed downmix signal, and transmits the decoded downmix signal to the upmixing unit 310.

The upmixing unit 310 upmixes the downmix signal by using the additional information, and transmits the upmixed signal to the multi-channel generating unit 330.

The effective residual signal processing unit 320 decodes the effective residual signals, and divides the decoded effective residual signals into effective residual signals according to multi channels by using the sorting information.

The multi-channel generating unit 330 restores n multi channels by using the audio signal upmixed by the upmixing unit 310, and the effective residual signals according to multi channels which are separated by the effective residual signal processing unit 320.

In this manner, according to the present exemplary embodiment, instead of decoding a whole residual signal, by decoding only an effective residual signal that exceeds a masking curve generated from an audio signal and that is in the residual signal, time taken to decode the residual signal and the decoding complexity are reduced and thus, decoding efficiency increases.

Figure 4:
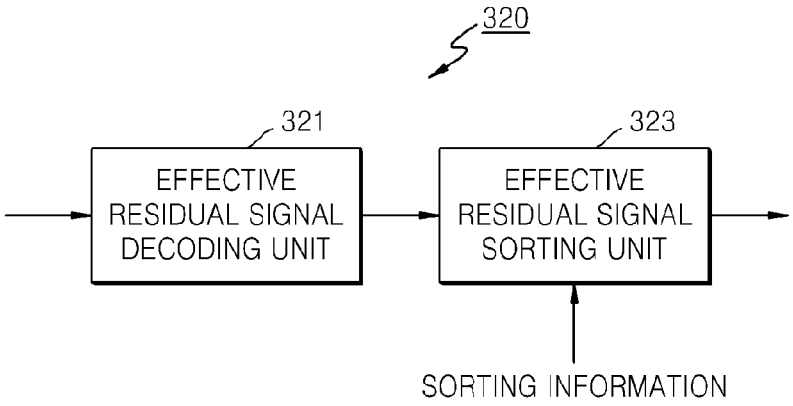
FIG. 4 is an internal block diagram of an effective residual signal processing unit in FIG. 3.

FIG. 4 is an internal block diagram of the effective residual signal processing unit 320 in FIG. 3. Referring to FIG. 4, the effective residual signal processing unit 320 includes an effective residual signal decoding unit 321 and an effective residual signal sorting unit 323. The effective residual signal decoding unit 321 decodes the encoded effective residual signals.

The effective residual signal decoding unit 321 divides the effective residual signal into a plurality of sub-bands in a frequency domain, and transforms the frequency domain into a time domain. The effective residual signal decoding unit 321 restores the effective residual signal by synthesizing signals of the domain-transformed sub-bands.

The effective residual signal sorting unit 323 separates the effective residual signal decoded by the effective residual signal decoding unit 321 into effective residual signals generated according to the multi channels, by using the sorting information. The sorting information includes at least one of channel identification information, domain identification information, and location information. Here, the channel identification information indicates to which channel that the sorted effective residual signal is separated. The domain identification information indicates whether the sorted effective residual signals are sorted on a frequency axis or a time axis, and the location information indicates frequency values of the effective residual signals before being sorted in the case where the effective residual signals are sorted on the frequency axis, or indicates time values of the effective residual signals before being sorted in the case where the effective residual signals are sorted on the time axis.

The effective residual signal sorting unit 323 separates the sorted effective residual signals into the effective residual signals for each of the multi channels, by using the channel identification information, the domain identification information, and the location information.

In this manner, according to the present exemplary embodiment, it is possible to separate the sorted effective residual signals into the effective residual signals generated according to the multi channels, by using the sorting information.

Figure 5:
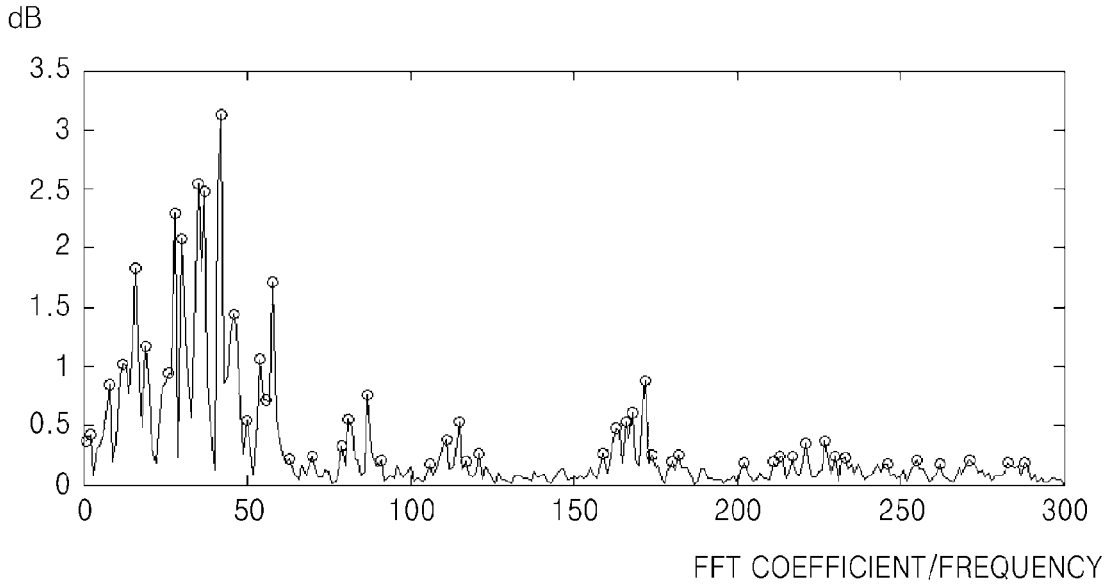
FIG. 5 is a graph of an effective residual signal with respect to a predetermined channel according to another exemplary embodiment.

FIG. 5 is a graph of an effective residual signal with respect to a predetermined channel according to another exemplary embodiment. In the graph of FIG. 5, a horizontal axis indicates a Fast Fourier Transform (FFT) coefficient or frequency, and a vertical axis indicates an amplitude value of the effective residual signal, that is, the vertical axis indicates the amplitude of the FFT coefficient. A decibel (dB) unit is obtained by taking logarithms to a value of the FFT coefficient and then multiplying a specific value by the value of the FFT coefficient.

A signal shown in FIG. 5 indicates a residual signal that is generated with respect to a specific channel from among multi channels. In the graph of FIG. 5, values marked by using circles indicate values of the effective residual signal which is not masked by a masking curve, when the masking curve generated from the specific channel is applied to the residual signal. A residual signal encoding apparatus (not shown) does not perform encoding on the whole residual signal but only performs encoding on the values marked by the circles.

As shown in the graph of FIG. 5, since the values of the effective residual signal to be encoded are not sequential, it is difficult to perform differential coding. Thus, the residual signal processing device 100 generates one or more signals by synthesizing effective residual signals, which are generated according to the multi channels, on a time or frequency axis, and performs encoding on the synthesized signals.

Figure 6:
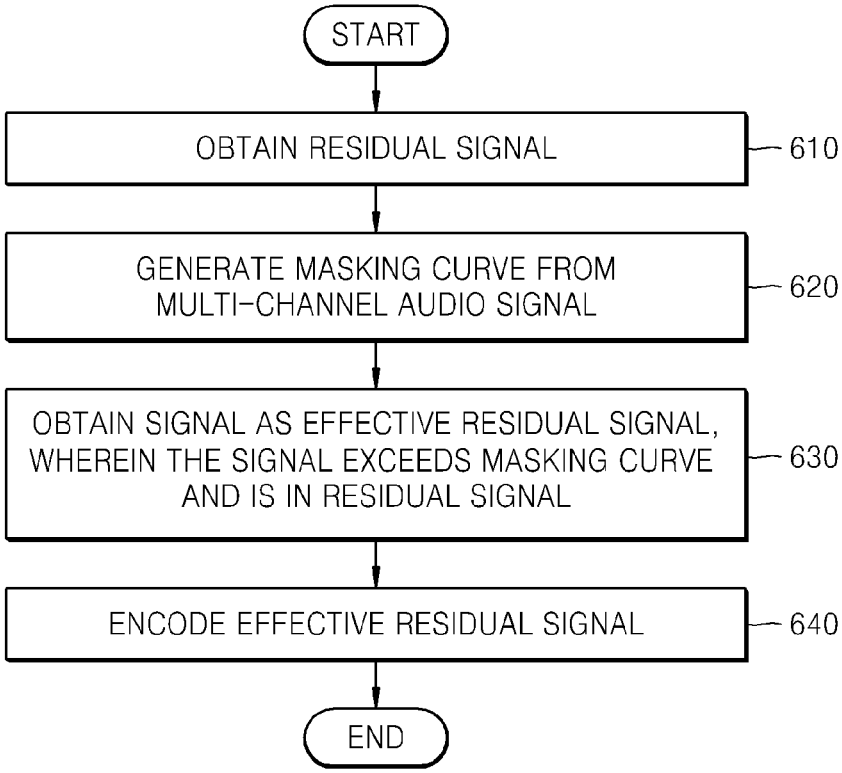
FIG. 6 is a flowchart of a residual signal encoding method, according to an exemplary embodiment.

FIG. 6 is a flowchart of a residual signal encoding method, according to an exemplary embodiment. Referring to FIG. 6, the residual signal processing device 100 obtains a residual signal that is a difference signal indicating a difference between a multi-channel audio signal, and an audio signal downmixed from the multi-channel audio signal, and then upmixed from the downmixed audio signal by using additional information (operation 610). The residual signal processing device 100 obtains the residual signal with respect to each of multi channels forming the multi-channel audio signal.

The residual signal processing device 100 generates a masking curve with respect to each of the multi channels forming the multi-channel audio signal (operation 620).

The residual signal processing device 100 extracts an effective residual signal that is not masked by the masking curve and that is in the residual signal (operation 630). The residual signal processing device 100 transforms the residual signal according to each of the multi channels into a frequency domain, divides the residual signal into a plurality of sub-bands, and extracts a signal with respect to each sub-band, wherein the signal exceeds a masking value of the masking curve.

The residual signal processing device 100 encodes the effective residual signal (operation 640). The residual signal processing device 100 may separately encode effective residual signals that are respectively generated according to the multi channels, or may sort the effective residual signals generated according to the multi channels and then may encode the sorted effective residual signals. In this case, the residual signal processing device 100 generates sorting information for separating the sorted effective residual signals into the effective residual signals generated according to the multi channels.

Figure 7:
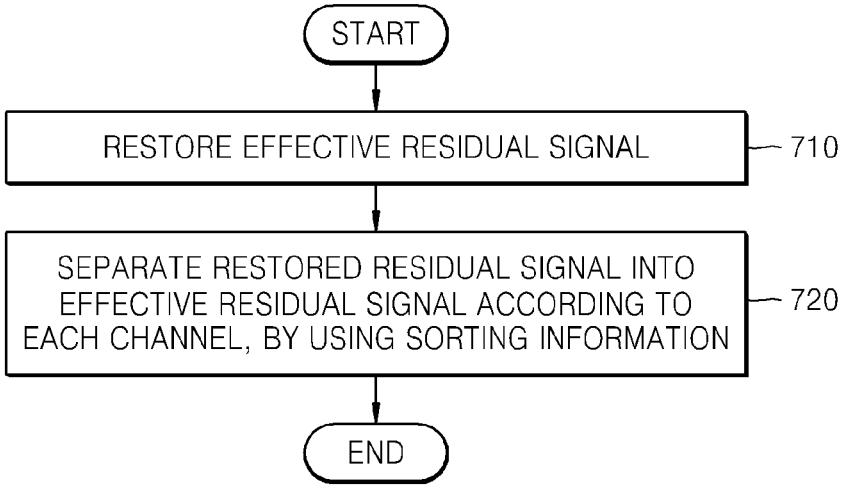
FIG. 7 is a flowchart of a residual signal decoding method, according to another exemplary embodiment.

FIG. 7 is a flowchart of a residual signal decoding method, according to another exemplary embodiment. Referring to FIG. 7, a residual signal decoding apparatus restores the effective residual signals transmitted from the residual signal processing device 100 (operation 710). The residual signal decoding apparatus divides the effective residual signals into a plurality of sub-bands, transforms the effective residual signals divided into the plurality of sub-bands in a frequency domain into a time domain, and thus synthesizes the transformed signals of the sub-bands.

The residual signal decoding apparatus separates the restored effective residual signals into the effective residual signals generated according to the multi channels, by using the sorting information (operation 720). The residual signal decoding apparatus extracts channel identification information, domain identification information, and location information from the sorting information, wherein the channel identification information is used to identify each channel, the domain identification information is used to indicate whether the effective residual signals have been sorted on a frequency axis or a time axis, and the location information is used to indicate frequency or time values of the effective residual signals. After that, the residual signal decoding apparatus obtains the effective residual signals generated according to the multi channels, by using the channel identification information, domain identification, and location information.

The residual signal encoding and decoding method and apparatus according to the exemplary embodiments can also be embodied as computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, etc. The computer readable recording medium can also be distributed over network coupled computer systems so that the computer readable code is stored and executed in a distributed fashion. Also, functional programs, codes, and code segments for accomplishing the exemplary embodiments can be easily construed by programmers of ordinary skill in the art to which the present invention pertains.

Expressions such as "at least one of," when preceding a list of elements, modify the entire list of elements and do not modify the individual elements of the list.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A residual signal encoding method comprising:

obtaining residual signals indicating differences between a multi-channel audio signal, and an audio signal downmixed from the multi-channel audio signal and then upmixed from the downmixed audio signal by using additional information;

generating masking curves from the multi-channel audio signal;

extracting signals that are not masked by the masking curves and that are in the residual signals, and obtaining the signals as effective residual signals; and encoding the effective residual signals.

2. The residual signal encoding method of claim 1, wherein the obtaining of the signal as the effective residual signals comprises:

transforming the residual signals into a frequency domain and dividing the transformed residual signals into a plurality of sub-bands; and extracting signals exceeding masking values of the masking curves, according to the plurality of sub-bands.

3. The residual signal encoding method of claim 1, wherein the residual signals and the masking curves are generated according to multi channels of the multi-channel audio signal, and wherein the obtaining of the signals as the effective residual signals comprises obtaining effective residual signals that exceed the masking curves and that are in the residual signals, according to the multi channels, the residual signal encoding method further comprising sorting the effective residual signals that are obtained according to the multi channels.

4. The residual signal encoding method of claim 3, further comprising generating sorting information for separating the sorted effective residual signals into the effective residual signals generated according to the multi channels, wherein the sorting information comprises at least one of channel identification information identifying the multi channels, domain identification information indicating whether the effective residual signals have been sorted on a frequency axis or a time axis, and location information for indicating frequency or time values of the effective residual signals.

5. The residual signal encoding method of claim 1, wherein the masking curves indicate maximum amplitudes of a signal at predetermined frequencies or times that are not perceptible due to the presence of a masking sound in the multi-channel audio signal, and wherein the extracting comprises extracting the effective residual signals that have amplitudes greater than the maximum amplitudes indicated by the masking curves.

6. A residual signal decoding method comprising:

dividing an encoded effective residual signals into a plurality of sub-bands in a frequency domain;

transforming the encoded effective residual signals divided into the plurality of sub-bands in the frequency domain into signals of a plurality of domain-transformed sub-bands in a time domain; and restoring effective residual signals by synthesizing signals of the plurality of domain-transformed sub-bands, wherein the encoded effective residual signals are generated by encoding signals that are in residual signals and that are not masked by masking curves generated with respect to a multi-channel audio signal.

7. The residual signal decoding method of claim 6, wherein the encoded effective residual signals comprise effective residual signals that are generated according to multi channels, sorted, and encoded, the residual signal decoding method further comprising separating the restored effective residual signals into effective residual signals with respect to the multi channels.

8. The residual signal decoding method of claim 7, wherein the separating of the restored effective residual signals comprises:

extracting channel identification information for identifying the multi channels, domain identification information for indicating whether the effective residual signals have been sorted on a frequency axis or a time axis, and location information for indicating frequency values or time values of the effective residual signals; and separating the restored effective residual signals according to the multi channels by using the channel identification information, the domain identification information, and the location information.

9. A residual signal encoding apparatus comprising:

a residual signal generating unit which obtains residual signals indicating differences between a multi-channel audio signal, and an audio signal downmixed from the multi-channel audio signal and then upmixed from the downmixed audio signal by using additional information;

a masking curve generating unit which generates masking curves from the multi-channel audio signal;

an effective residual signal extracting unit which extracts signals that are not masked by the masking curves and that are in the residual signals, and obtains the signals as effective residual signals; and an effective residual signal encoding unit which encodes the effective residual signals.

10. The residual signal encoding apparatus of claim 9, wherein the effective residual signal extracting unit transforms the residual signals into a frequency domain, divides the transformed residual signal into a plurality of sub-bands, and extracts signals exceeding masking values of the masking curves, according to the plurality of sub-bands.

11. The residual signal encoding apparatus of claim 9, wherein the residual signal generating unit, the masking curve generating unit, and the effective residual signal extracting unit respectively obtain difference signals, masking curves, and an effective residual signals according to multi channels of the multi-channel audio signal, the residual signal encoding apparatus further comprising an effective residual signal sorting unit which sorts the effective residual signals that are obtained according to the multi channels, and wherein the effective residual signal encoding unit encodes the sorted effective residual signals.

12. The residual signal encoding apparatus of claim 11, further comprising a sorting information generating unit that generates sorting information for separating the sorted effective residual signals into the effective residual signals generated according to the multi channels, wherein the sorting information generating unit generates the sorting information comprising at least one of channel identification information for identifying the multi channels, domain identification information for indicating whether the effective residual signals have been sorted on a frequency axis or a time axis, and location information for indicating frequency values or time values of the effective residual signals.

13. A residual signal decoding apparatus comprising:

an effective residual signal decoding unit which divides encoded effective residual signals into a plurality of sub-bands in a frequency domain, transforms the encoded effective residual signals divided into the plurality of sub-bands in the frequency domain into a plurality of domain-transformed sub-bands in a time domain, and restoring effective residual signals by synthesizing signals of the plurality of domain-transformed sub-bands, wherein the encoded effective residual signals is generated by encoding signals that are in residual signals and that are not masked by masking curves generated with respect to a multi-channel audio signal.

14. The residual signal decoding apparatus of claim 13, wherein the encoded effective residual signals comprise effective residual signals that are generated according to multi channels, sorted, and then encoded, the residual signal decoding apparatus further comprising an effective residual signal sorting unit for separating the restored effective residual signals into effective residual signals with respect to the multi channels.

15. The residual signal decoding apparatus of claim 14, wherein the effective residual signal sorting unit extracts channel identification information for identifying the multi channels, domain identification information for indicating whether the effective residual signals have been sorted on a frequency axis or a time axis, and location information for indicating frequency values or time values of the effective residual signals, and separates the restored effective residual signals according to the multi channels by using the channel identification information, the domain identification information, and the location information.

16. A non-transitory computer readable recording medium having recorded thereon a program for executing a residual signal encoding method comprising:

obtaining residual signals indicating differences between a multi-channel audio signal, and an audio signal downmixed from the multi-channel audio signal and then upmixed from the downmixed audio signal by using additional information;

generating masking curves from the multi-channel audio signal;

extracting signals that are not masked by the masking curves and that are in the residual signals, and obtaining the signals as effective residual signals; and encoding the effective residual signals.

17. A non-transitory computer readable recording medium having recorded thereon a program for executing a residual signal decoding method comprising:

dividing encoded effective residual signals into a plurality of sub-bands in a frequency domain;

transforming the encoded effective residual signals divided into the plurality of sub-bands in the frequency domain into signals of a plurality of domain-transformed sub-bands in a time domain; and restoring effective residual signals by synthesizing the signals of the plurality of domain-transformed sub-bands, wherein the encoded effective residual signals are generated by encoding signals that are in residual signals and that are not masked by masking curves generated with respect to a multi-channel audio signal.

18. An encoding method comprising:

determining a difference between one channel of a multi-channel audio signal, and an audio signal downmixed from the multi-channel audio signal and then upmixed from the downmixed audio signal;

generating a masking curve from the multi-channel audio signal;

determining a portion of the difference that does not exceed the masking curve; and encoding the determined portion.

19. The encoding method of claim 18, wherein the difference is a residual signal.

20. The encoding method of claim 18, wherein the determined portion is an effective residual signal.

* * * * *